US011373604B2

(12) United States Patent
Xie

(10) Patent No.: US 11,373,604 B2
(45) Date of Patent: Jun. 28, 2022

(54) DRIVER CIRCUIT FOR DISPLAY PANEL, DISPLAY PANEL AND DRIVING METHOD FOR DISPLAY PANEL

(71) Applicant: YUNGU (GU' AN) TECHNOLOGY CO., LTD., Hebei (CN)

(72) Inventor: Hongjun Xie, Langfang (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 17/475,808

(22) Filed: Sep. 15, 2021

(65) Prior Publication Data

US 2022/0005419 A1 Jan. 6, 2022

Related U.S. Application Data

(63) Continuation of application No. PCT/CN2020/088334, filed on Apr. 30, 2020.

(30) Foreign Application Priority Data

Aug. 29, 2019 (CN) ..... 201910820801.5

(51) Int. Cl.
*G09G 3/3291* (2016.01)

(52) U.S. Cl.
CPC ... *G09G 3/3291* (2013.01); *G09G 2300/0439* (2013.01); *G09G 2310/027* (2013.01)

(58) Field of Classification Search
CPC ..... G09G 3/3233; G09G 2300/0842; G09G 2300/0819; G09G 2320/043;
(Continued)

(56) References Cited

U.S. PATENT DOCUMENTS

2011/0298836 A1 12/2011 Komiya et al.
2015/0179105 A1* 6/2015 Mizukoshi ..... G09G 3/3233 345/76

(Continued)

FOREIGN PATENT DOCUMENTS

CN 101414435 A 4/2009
CN 101577994 A 11/2009

(Continued)

OTHER PUBLICATIONS

International Search Report dated Jul. 29, 2020 in corresponding International application No. PCT/CN2020/088334; 5 pages.

(Continued)

*Primary Examiner* — Dong Hui Liang
(74) *Attorney, Agent, or Firm* — Maier & Maier, PLLC

(57) ABSTRACT

A driver circuit of a display panel, a display panel, and a driving method of the display panel. The display panel includes a plurality of sub-pixel units, and the driver circuit includes a plurality of detection capacitors, a detection capacitor and a compensation module; a first end of each of the plurality of detection capacitors is electrically connected to the plurality of sub-pixel units, and a second end of each of the plurality of detection capacitors is grounded; a first end of the drive module is electrically connected to the first end of each of the plurality of detection capacitors; and a second end of the drive module is electrically connected to the compensation module.

18 Claims, 8 Drawing Sheets

(58) Field of Classification Search
CPC ..... G09G 2320/045; G09G 2320/0295; G09G 2320/0233
See application file for complete search history.

(56) References Cited

U.S. PATENT DOCUMENTS

| | | | | |
|---|---|---|---|---|
| 2017/0206839 | A1* | 7/2017 | Wu | G09G 3/3233 |
| 2019/0035335 | A1 | 1/2019 | Kim et al. | |
| 2019/0237008 | A1 | 8/2019 | Ho et al. | |
| 2021/0028265 | A1* | 1/2021 | Kim | G09G 3/3266 |

FOREIGN PATENT DOCUMENTS

| | | | |
|---|---|---|---|
| CN | 104299563 | A | 1/2015 |
| CN | 105321456 | A | 2/2016 |
| CN | 106847180 | A | 6/2017 |
| CN | 107039004 | A | 8/2017 |
| CN | 107134254 | A | 9/2017 |
| CN | 107424559 | A | 12/2017 |
| CN | 109308879 | A | 2/2019 |
| CN | 109616050 | A | 4/2019 |
| CN | 110491339 | A | 11/2019 |

OTHER PUBLICATIONS

First Office Action and Search Report dated Jun. 16, 2020 in corresponding Chinese application No. 201910820801.5; 18 pages including Machine-generated English-language translation.

* cited by examiner

DRIVER CIRCUIT FOR DISPLAY PANEL, DISPLAY PANEL AND DRIVING METHOD FOR DISPLAY PANEL

CROSS-REFERENCE TO RELATED APPLICATIONS

This application is a continuation of International Patent Application No. PCT/CN2020/088334, filed on Apr. 30, 2020, which claims priority to Chinese Patent Application No. 201910820801.5 filed on Aug. 29, 2019, the disclosures of both of which are incorporated herein by reference in their entireties.

TECHNICAL FIELD

Embodiments of the present application relate to display technologies, for example, a driver circuit of a display panel, the display panel, and a driving method of the display panel.

BACKGROUND

An organic light emitting diode (OLED) display panel has advantages of self-illumination, low drive voltage, high luminous efficiency, short response time, high definition and contrast, wide use temperature range, capability of realizing flexible display and large-area full-color display and the like, and is recognized as a display panel with a highest development potential in the industry.

However, there is an uneven display in pictures of the OLED display panel in the related art.

SUMMARY

The present application provides a driver circuit of a display panel, the display panel, and a driving method of the display panel, to compensate an aging of an OLED device so as to improve a situation of an uneven display of the display panel.

In a first aspect, an embodiment of the present application provides a driver circuit of a display panel. The display panel includes a plurality of sub-pixel units, and the driver circuit includes a plurality of detection capacitors, a drive module and a compensation module; first ends of the plurality of detection capacitor are electrically connected to the plurality of sub-pixel units, and second ends of the plurality of detection capacitor are grounded; a first end of the drive module is electrically connected to the first end of each of the plurality of detection capacitors, and the drive module is configured to acquire, in a detection mode, a voltage of the each of the plurality of detection capacitors after being discharged through a sub-pixel unit corresponding to each of the plurality of detection capacitors within a detection time duration; and a second end of the drive module is electrically connected to the compensation module, and the compensation module is configured to determine a compensation gain value corresponding to the plurality of sub-pixel units according to a discharged voltage and determine a drive signal of the plurality of sub-pixel units upon displaying a preset gray scale according to the compensation gain value; where the detection time duration is determined according to a service time duration of the display panel.

In a second aspect, an embodiment of the present application further provides a display panel. The display panel includes the driver circuit of the display panel described in any of the embodiments of the present application.

In a third aspect, an embodiment of the present application further provides a driving method of a display panel. The method includes a voltage of each of the plurality of detection capacitors after being discharged through a sub-pixel unit corresponding to each of the plurality of detection capacitors within a detection time duration is acquired in a detection mode; and a compensation gain value corresponding to the plurality of sub-pixel units is determined according to a discharged voltage, and a drive signal of the plurality of sub-pixel units upon displaying a preset gray scale is determined according to the compensation gain value; where the detection time duration is determined according to a service time duration of the display panel.

According to the embodiments of the present disclosure, the voltage of each of the plurality of detection capacitors after being discharged through the sub-pixel unit corresponding to each of the plurality of detection capacitors within the detection time duration is acquired, the compensation gain value corresponding to the plurality of sub-pixel units is determined according to the discharged voltage, and the drive signal of the plurality of sub-pixel units upon displaying the preset gray scale is determined according to the compensation gain value. Moreover, along with the increase of the service time duration of the display panel, an aging degree of the OLED device in the sub-pixel unit is gradually increased, a discharge capacity of the OLED device is changed, and after each of the plurality of detection capacitors is discharged through the sub-pixel unit for a same time, a voltage value of each of the plurality of detection capacitors after being discharged is changed, so that the voltage value of each of the plurality of detection capacitors after being discharged gradually deviates from an optimal detection range of the drive module, a detection precision of the voltage value after being discharged is reduced, and thus a compensation precision is affected. According to this embodiment, the detection time duration is set to be determined according to the service time duration of the display panel, so that the voltage value of each of the plurality of detection capacitors after being discharged is always in the optimal detection range of the drive module within the detection time duration.

DETAILED DESCRIPTION

There is a situation of the uneven display in pictures of the OLED display panel in practical use. Research finds that the reason for this situation is that: the OLED display panel adopts an organic material to manufacture a light emitting device, and the OLED device is susceptible to varying degrees of aging along with the increase of a service time duration, so that a light emitting brightness of the light emitting device is changed, and thus the situation of the uneven display in the pictures occurs.

Figure 1:
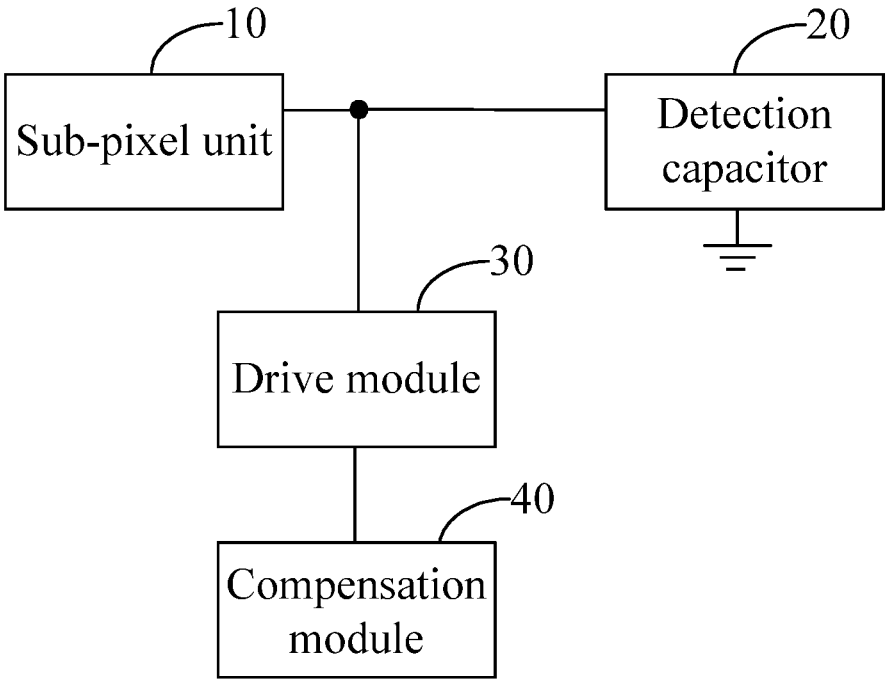
FIG. 1 is a schematic diagram of a driver circuit of a display panel provided in an embodiment of the present application.
Figure 6:
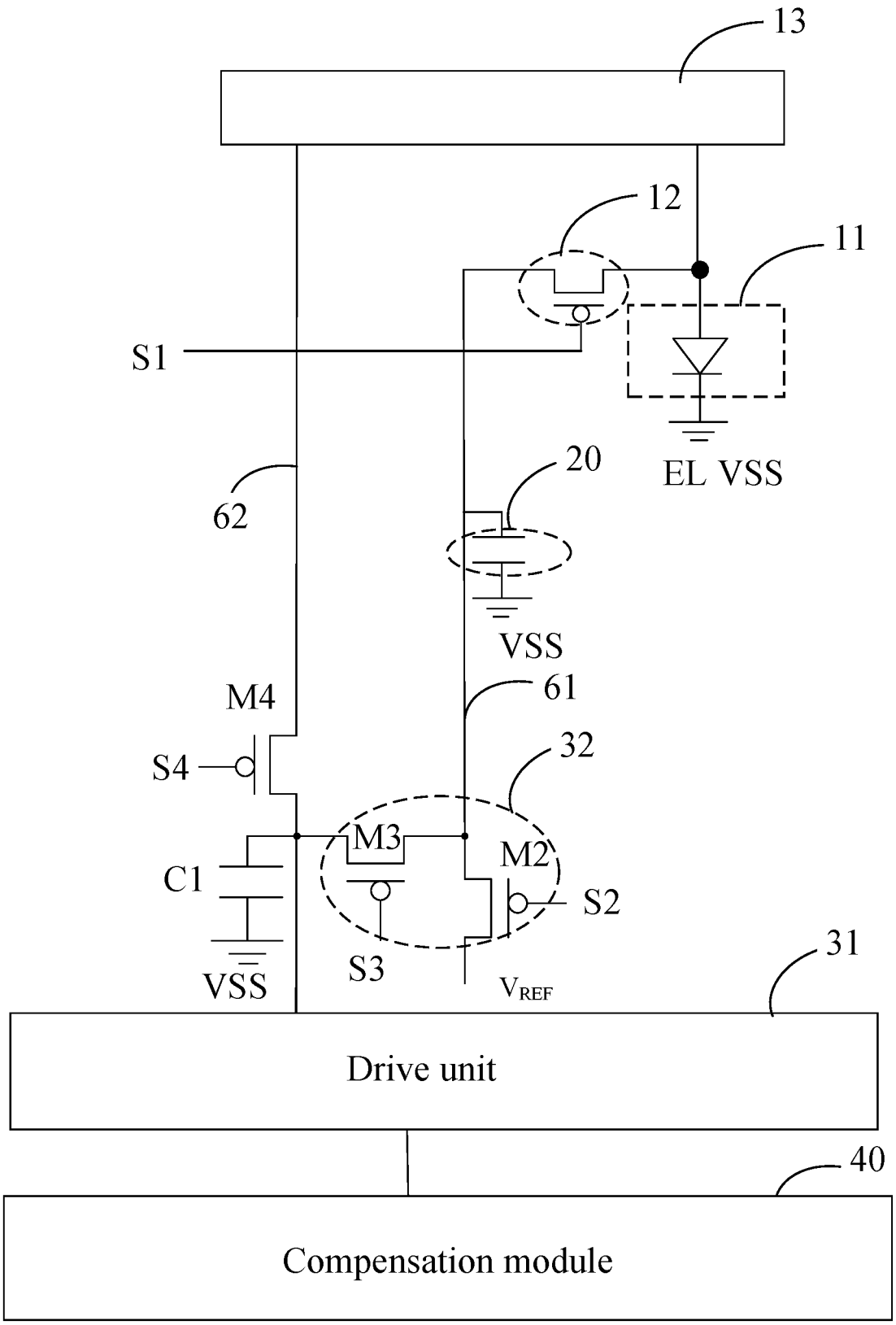
FIG. 6 is a schematic diagram of still another driver circuit of a display panel provided in an embodiment of the present application.
Figure 7:
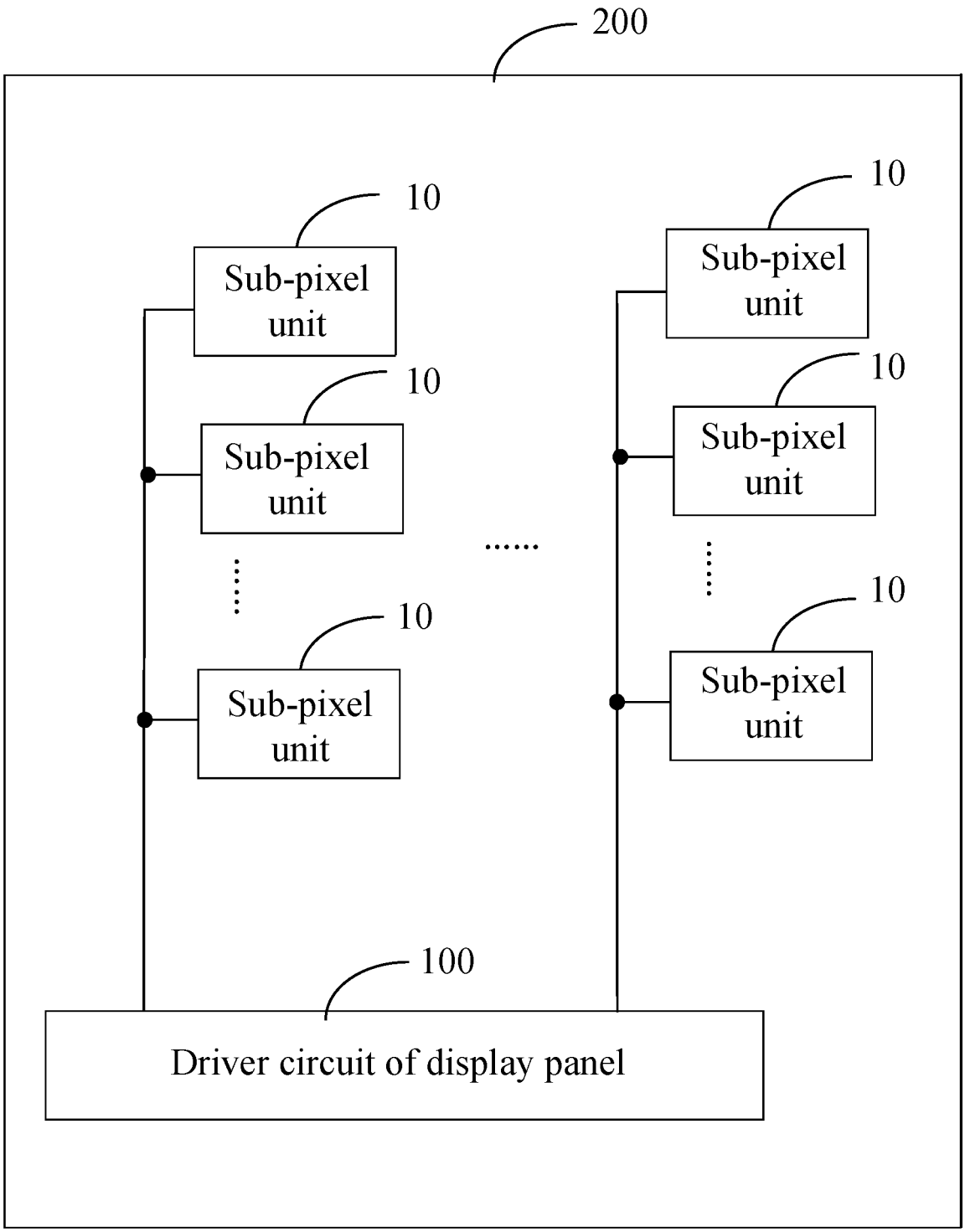
FIG. 7 is a schematic diagram of a display panel provided in an embodiment of the present application.

This embodiment provides a driver circuit of a display panel, referring to FIGS. 1, 6 and 7, the display panel includes a plurality of sub-pixel units 10 configured in an array with a plurality of rows and columns. The driver circuit includes a plurality of detection capacitors 20, a drive module 30 and a compensation module 40.

First ends of the plurality of detection capacitor 20 are electrically connected to the plurality of sub-pixel unit 10 and second ends of each of the plurality of detection capacitors 20 is grounded. A first end of the drive module 30 is electrically connected to the first ends of the plurality of detection capacitors 20 and a second end of the drive module 30 is electrically connected to the compensation module 40.

The drive module 30 is configured to acquire, in a detection mode, a voltage of each of the plurality of detection capacitors 20 after being discharged through a sub-pixel unit 10 corresponding to each of the plurality of detection capacitors 20 within a detection time duration.

The compensation module 40 is configured to determine a compensation gain value corresponding to the plurality of sub-pixel units 10 according to a discharged voltage and determine a drive signal of the plurality of sub-pixel units 10 upon displaying a preset gray scale according to the compensation gain value; where the detection time duration is determined according to a service time duration of the display panel.

Specifically, as each of the plurality of detection capacitors 20 is electrically connected to a corresponding one of the plurality of columns of the sub-pixel units 10, first ends of the plurality of detection capacitor 20 are electrically connected to the corresponding one of the plurality of columns of sub-pixel unit 10.

In the detection mode, the sub-pixel unit 10 is not used for displaying a picture. The detection mode may include a pre-charging stage, a discharging stage, and a voltage sampling stage. In the pre-charging stage, the drive module 30 provides a reference voltage to each of the plurality of detection capacitors 20; in the discharging stage, a reference voltage written in each of the plurality of detection capacitors 20 is discharged through an OLED device of the plurality of sub-pixel units 10; in the voltage sampling stage, the drive module 30 collects a voltage of each of the plurality of detection capacitors 20, so that the voltage of each of the plurality of detection capacitors 20 after being discharged through the corresponding sub-pixel unit 10 is determined, where the discharging stage and the voltage sampling stage constitute the detection time duration. Since the voltage of each of the plurality of detection capacitors 20 after being discharged reflects a discharge capacity of the OLED device in the sub-pixel unit 10 and thus reflects an aging degree of the OLED device, in the present application, the voltage of each of the plurality of detection capacitors 20 after being discharged through the sub-pixel unit 10 corresponding to each of the plurality of detection capacitors within the detection time duration is acquired, the compensation gain value corresponding to the plurality of sub-pixel units 10 is determined according to the discharged voltage, and the drive signal of the plurality of sub-pixel units 10 upon displaying the preset gray scale is determined according to the compensation gain value, so that an aging of the OLED device may be compensated, and thus the uneven display of the display panel is improved.

Moreover, along with the increase of the service time duration of the display panel, an aging degree of the OLED device in the sub-pixel unit 10 is gradually increased, the discharge capacity of the OLED device is changed, and after each of the plurality of detection capacitors 20 is discharged through the sub-pixel unit 10 for a same time, a voltage value of each of the plurality of detection capacitors 20 after being discharged is changed, so that the voltage value of each of the plurality of detection capacitors 20 after being discharged gradually deviates from an optimal detection range of the drive module 30, a detection precision of the voltage value after being discharged is reduced, and thus a compensation precision is affected. According to this embodiment, the detection time duration is set to be determined according to the service time duration of the display panel, so that the voltage value of each of the plurality of detection capacitors 20 after being discharged is always in the optimal detection range of the drive module 30 within the detection time duration, the detection precision of the voltage value is improved, a determination precision of a compensation gain is improved, and thus an aging compensation precision of the display panel is improved.

It should be noted that the service time duration of the display panel may be determined by reading data representing the service time duration in the display panel, and may also be determined by setting a timer and the like.

Figure 2:
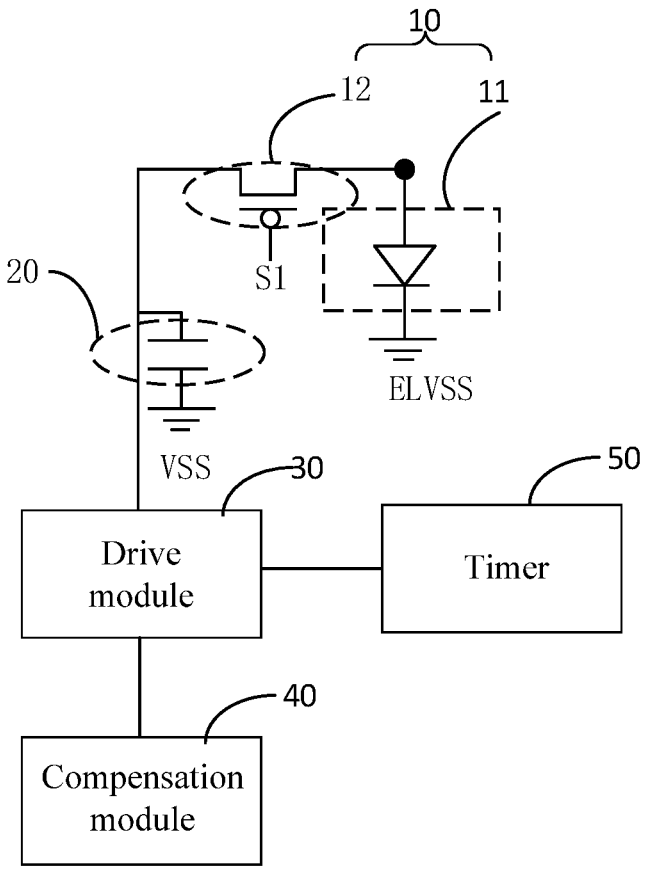
FIG. 2 is a schematic diagram of another driver circuit provided in an embodiment of the present application.

Referring to FIG. 2, the driver circuit further includes a timer 50 electrically connected to a third end of the drive module 30.

The timer 50 is configured to measure the service time duration of the display panel.

The drive module 30 is configured to determine the detection time duration according to the service time duration measured by the timer 50.

The timer 50 is configured to measure the service time duration of the display panel, it is ensured that the obtained a service time duration of the display panel is more accurate, whereby it is ensured that the determined detection time duration is more accurate, and it is ensured that the aging compensation precision is high.

In the early period of use of the display panel, the discharge capacity of the OLED device is stronger, the detection time duration T23 may be set to be a smaller value t23, and the voltage of each of the plurality of detection capacitors 20 after being discharged is within the optimal detection range of the drive module 30. In the later period of use of a product, the discharge capacity of the OLED device is weaker, the detection time duration T23 may be set to be a larger value, the discharge time of each of the plurality of detection capacitors 20 is prolonged, so that the voltage after being discharged is still within the optimal detection range of the drive module 30, whereby the detection precision of a voltage value is improved, the determination precision of a compensation gain is improved, and thus the aging compensation precision of the display panel is improved.

Exemplarily, in a case where the service time duration t of the display panel is less than or equal to a set value, a value of the detection time duration T23 is equal to an initial detection time duration t23, and in a case where the service time duration t of the display panel is larger than the set value, T23=K*t, K is an aging coefficient, the K is directly related to an aging speed of the OLED device, and the aging speed is the faster, the K is the larger, while the aging speed is the slower, the K is the smaller. Exemplarily, the set value is tp, tp is a time constant.

In an embodiment, referring to FIG. 2, the sub-pixel unit 10 includes a first switch 12 and an organic light emitting diode 11.

A first end of the first switch 12 is electrically connected to the organic light emitting diode 11, a second end of the first switch 12 is electrically connected to the first end of each of the plurality of detection capacitors 20, and a control end of the first switch 12 is configured to receive a first control signal S1.

In the pre-charging stage, the first switch 12 is switched off, a conduction channel between each of the plurality of detection capacitors 20 and the organic light emitting diode 11 is switched off, and the drive module 30 charges each of the plurality of detection capacitors 20.

In the discharging stage and the voltage sampling stage, the first switch 12 is switched on, and each of the plurality of detection capacitors 20 is discharged through the organic light emitting diode 12. The sub-pixel unit 10 may further include a pixel driver circuit used for driving the sub-pixel unit 10 to emit light and the like, and the first switch 12 may be a thin film transistor in the pixel driver circuit. The first control signal S1 may be provided by the drive module 30 or the compensation module 40 or may be provided by other timing control circuits.

In an embodiment, the compensation module 40 determines the compensation gain value corresponding to the plurality of sub-pixel units by adopting a following formula:

$$\text{Gain} = \frac{T23}{t23} \cdot \frac{V_{REF} - V_{SEN0}}{V_{REF} - V_{SEN}}$$

In a case of t>tp, then T23=K*t; in a case of t ≤ tp, then T23=t23; K is an aging coefficient of the display panel, t is the service time duration of the display panel, and tp is a time constant;

$V_{SEN}$ is a voltage of each of the plurality of detection capacitors after being discharged within the detection time duration T23 at a current moment; $V_{SEN0}$ is a voltage of each of the plurality of detection capacitors after being discharged within the initial detection time duration t23 in factory shipment; $V_{REF}$ is a reference voltage of each of the plurality of detection capacitors before being discharged; and Gain is the compensation gain value corresponding to the plurality of sub-pixel units 10.

Figure 3:
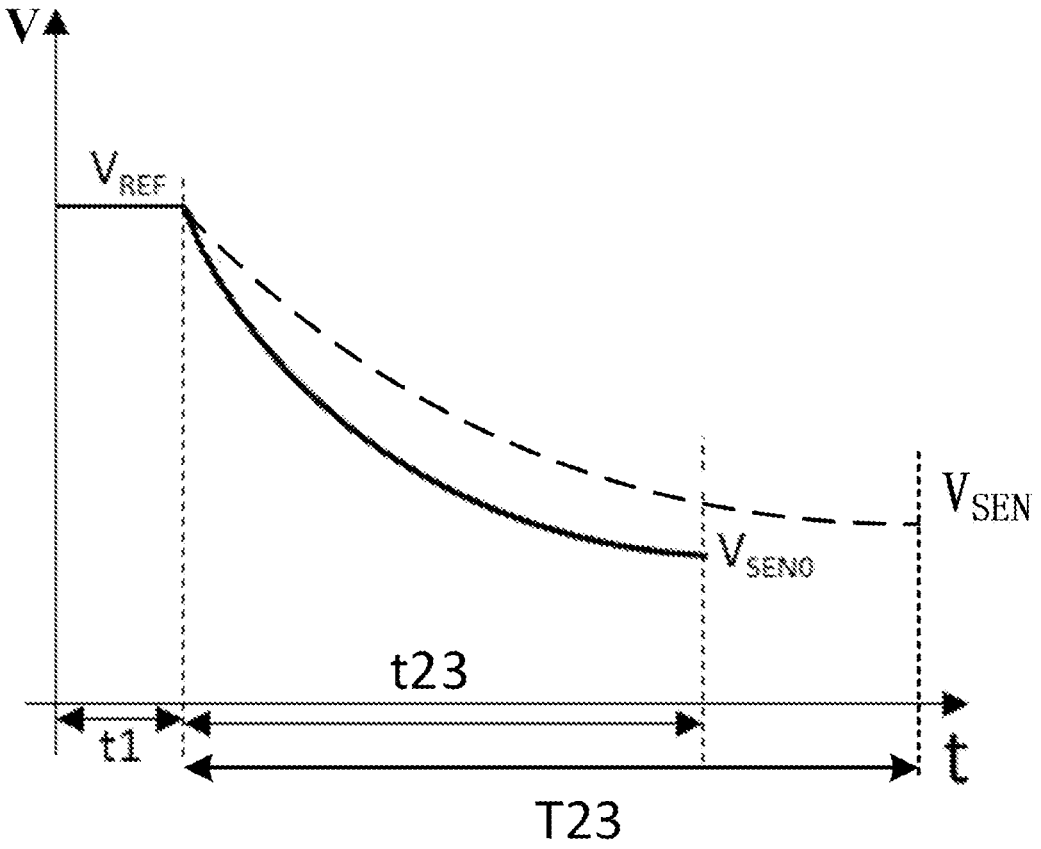
FIG. 3 is a schematic diagram of a voltage of a detection capacitor provided in an embodiment of the present application.

Referring to FIG. 3, after the display panel is used for a period of time, the voltage $V_{SEN}$ of each of the plurality of detection capacitors 20 after being discharged is still within the optimal detection range of the drive module 30 by setting the detection time duration T23 to adopt a larger value, whereby a detection precision of a voltage value is improved. Moreover, the compensation gain in this application comprehensively considers the service time duration of the display panel, and thus the aging compensation precision of the display panel is improved.

Moreover, the compensated drive signal may be determined by adopting a following formula, the drive signal includes a driving current and a drive voltage, $I'=\text{Gain}\cdot I_0$, where $I_0$ is a driving current without compensation, I' is driving current with compensation, and Gain is the compensation gain value corresponding to the plurality of sub-pixel units; where $I_0=K_1(\text{ELVDD}-V_{DATA})^2$, $V_{DATA}$ is a drive voltage without compensation, ELVDD is a first reference voltage of the pixel driver circuit, $K_1$ is a constant, and $V_{DATA}'$ is a drive voltage with compensation, i.e., $V_{DATA}'=\text{ELVDD}-\sqrt{\text{Gain}}\cdot(\text{ELVDD}-V_{DATA})$.

Figure 4:
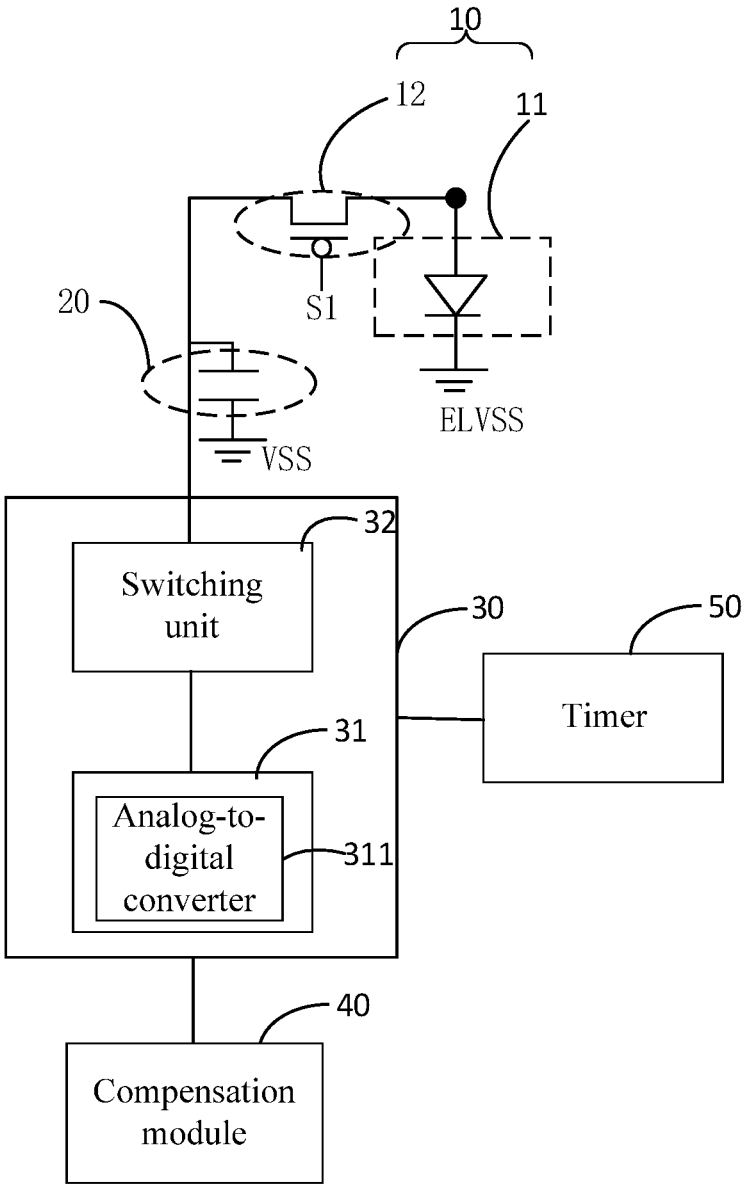
FIG. 4 is a schematic diagram of another driver circuit of a display panel provided in an embodiment of the present application.

Referring to FIG. 4, the drive module 30 includes a drive unit 31, the drive unit 31 is configured to provide a reference voltage to each of the plurality of detection capacitors 20, and the drive unit 31 may further configured to collect a voltage of each of the plurality of detection capacitors 20 after being discharged within the detection time duration.

The drive unit 31 includes an analog-to-digital converter 311.

A detection voltage range of the analog-to-digital converter 311 is determined according to a service time duration of the display panel.

The analog-to-digital converter 311 is configured to convert an analog signal detected by the drive unit 31 into a digital signal, the analog-to-digital converter 311 has a detection voltage range, and an input voltage of the analog-to-digital converter 311 is closer to a middle position of the detection voltage range, a linearity of the analog-to-digital converter 311 is the better and a conversion precision is the higher; while the input voltage of the analog-to-digital converter 311 is farther from the middle position, the linearity of the analog-to-digital converter 311 is the worse, and the conversion accuracy is the worse. The detection voltage range of the analog-to-digital converter 311 is adjusted according to the service time duration of the display panel in this application, so that a voltage value of each of the plurality of detection capacitors 20 after being discharged is always located in the middle position of the detection voltage range of the analog-to-digital converter 311, whereby the conversion precision of the analog-to-digital converter 311 is improved, the detection precision of the voltage value is improved, and thus the aging compensation precision of the display panel is improved.

Figure 5:
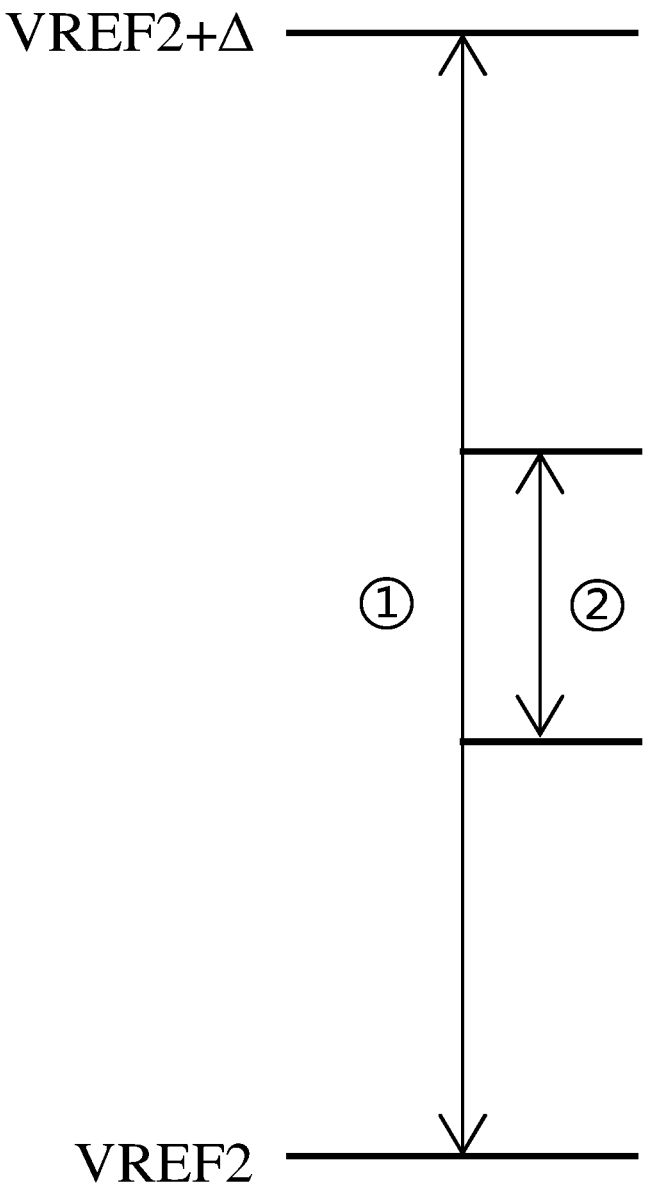
FIG. 5 is a schematic diagram of a detection voltage range of an analog-to-digital converter provided in an embodiment of the present application.

Referring to FIG. 5, ① is the detection voltage range of the analog-to-digital converter, ② is a voltage interval to be detected of each of the plurality of detection capacitors, VREF2 is a minimum detection voltage of the analog-to-digital converter, and VREF2+Δ is a maximum detection voltage of the analog-to-digital converter; due to a fact that a discharge capacity of the organic light emitting diode is weakened with the increase of the service time duration, a voltage of each of the plurality of detection capacitors after being discharged may be gradually increased, a value of the VREF2 may be gradually increased along with the increase of the service time duration of the display panel, so that the voltage interval to be detected ② is always located in the middle of the detection voltage range ① of the analog-to-digital converter.

It should be noted that the detection voltage range of the analog-to-digital converter may be adjusted by adjusting an input reference voltage of the analog-to-digital converter.

In an embodiment, referring to FIG. 4, the drive module 30 further includes a switching unit 32, the drive unit 31 is electrically connected to the sub-pixel unit 10 through the switching unit 32.

The switching unit 32 is configured to switch a corresponding conduction channel based on a working state of the drive unit 31.

In an embodiment, in the pre-charging stage, the switching unit 32 switched on a charging path between the drive unit 31 and each of the plurality of detection capacitors 20, and the drive unit 31 charges each of the plurality of detection capacitors 20. In the voltage sampling stage, the switching unit 32 switches on a measurement path between the drive unit 31 and each of the plurality of detection capacitors 20, and collects a voltage of each of the plurality of detection capacitors 20 after being discharged. The switching unit 32 is set so that the drive unit 31 may realize charging and voltage detection of each of the plurality of detection capacitors 20, namely, a charging circuit and a detection circuit may be integrated in the drive unit 31 without separate arrangement, so that the size of the drive module 30 is reduced.

In an embodiment with reference to FIG. 6, the switching unit 32 includes a second switch M2 and a third switch M3. A control end of the second switch M2 is configured to receive a second control signal S2, a first end of the second switch M2 is connected to the first end of each of the plurality of detection capacitors 20, and a second end of the second switch M2 is configured to input a reference voltage. A control end of the third switch M3 is configured to receive a third control signal S3, a first end of the third switch M3 is electrically connected to the drive unit 31, and a second end of the third switch M3 is connected to the first end of the second switch M2.

In an embodiment, in the pre-charging stage, the drive unit 31 provides a reference voltage $V_{REF}$. When the second control signal S2 is invalid, the third control signal S3 is valid, the second switch M2 is switched off, and the third switch M3 is switched on, at this time, the drive unit 31 provides the reference voltage $V_{REF}$ to charge each of the plurality of detection capacitors 20, and a pre-charging process is completed.

In order to improve the detection precision, it is required to ensure that the time of the pre-charging stage is long enough, that is, it is ensured that each of the plurality of detection capacitors 20 is charged to be saturated, so that the current flowing through the third switch M3 is infinite, that is, a voltage difference between a drain electrode and a source electrode of the third switch M3 is very small, and a time of the pre-charging stage may be obtained through simulation or experiment.

In the discharging stage, the third control signal S3 and the first control signal S1 are valid, the second control signal S2 is invalid, and the third switch M3 and the first switch 12 are switched on; at this time, charges on each of the plurality of detection capacitors 20 flow through the organic light emitting diode 11 through the first switch 12, a voltage of each of the plurality of detection capacitors 20 is gradually reduced from the reference voltage $V_{REF}$, and the voltage of each of the plurality of detection capacitors 20 is transmitted to the drive unit 31 through the third switch M3.

In the discharging stage, it is required to ensure that a difference value between the voltage of each of the plurality of detection capacitors 20 and a second reference voltage ELVSS upon discharging is larger than a turn-on voltage Vth of the organic light emitting diode 11, that is, it needs to be ensured that the organic light emitting diode 11 is in a switched on state in the discharging stage so that a discharging path is formed.

In the voltage sampling stage, the third control signal S3 and the first control signal S1 remain valid, and the drive unit 31 collects the voltage of each of the plurality of detection capacitors 20.

Moreover, in the pre-charging stage, the second control signal S2 may be set to be effective, and the second switch M2 is switched on; at this time, each of the plurality of detection capacitors 20 is charged through the reference voltage $V_{REF}$ provided by the second switch M2, and the pre-charging process is completed. At this time, the drive unit 31 is only configured to collect the voltage of each of the plurality of detection capacitors 20, a current required for pre-charging does not need to be provided by the drive unit 31, and the heat generation of the drive unit 31 may be reduced.

Moreover, the drive module may be a driver chip of the display panel, the sub-pixel unit further includes a pixel driver circuit 13 used for driving the sub-pixel unit to emit light, the drive unit 31 is electrically connected to the first end of the third switch M3 through a data bus 62, and the driver circuit further includes a first capacitor C1 and a fourth switch M4. A first end of the fourth switch M4 is electrically connected to the first end of the third switch M3 and a first end of the first capacitor C1, a second end of the fourth switch M4 is electrically connected to the pixel driver circuit 13 through the data bus 62, and a control end of the fourth switch M4 is configured to receive a fourth control signal S4. A second end of the first capacitor C1 is grounded. In the detection mode, the fourth switch M4 is switched off, and the data bus 62 does not provide a data signal to the pixel driver circuit 13, i.e., the sub-pixel unit does not display a picture.

The first capacitor C1 is a stray capacitor corresponding to the data bus 62 arranged in the fan-shaped wiring region. The first capacitor C1 is charged simultaneously in the pre-charging stage, the first capacitor C1 is discharged through the third switch M3 in the discharging stage, and a current flowing through the third switch M3 is less than a current flowing through the organic light emitting diode 11. It should be understood that the current flowing through the organic light emitting diode 11 comes from each of the plurality of detection capacitors 20 and the first capacitor C1, so that the current flowing through the third switch M3 is only a part of the current flowing through the organic light emitting diode 11. During sampling, in a case where a current of the organic light emitting diode 11 is very small, the current flowing through the third switch M3 is smaller, so that a drain-source voltage difference of the third switch M3 is very small, and thus the detection accuracy is improved.

Moreover, a same column of sub-pixel units may be connected to a same detection capacitor 20, a same switching unit 32 and a same drive unit 31 through a same sensing line 61, and each column of sub-pixel units correspond to one detection capacitor 20, one switching unit 32 and one drive unit 31. A time sequence of the first control signal S1, a time sequence of the second control signal S2 and a time sequence of the third control signal S3 is arranged so that the collection of a voltage after being discharged corresponding to each sub-pixel unit in a column of sub-pixel units is realized, and thus the aging compensation of each sub-pixel unit is realized.

This embodiment further provides a display panel, FIG. 7 is a schematic diagram of a display panel provided in an embodiment of the present application, and referring to FIG. 7, the display panel 200 includes the driver circuit 100 of the display panel provided by any embodiment of the present disclosure.

Figure 8:
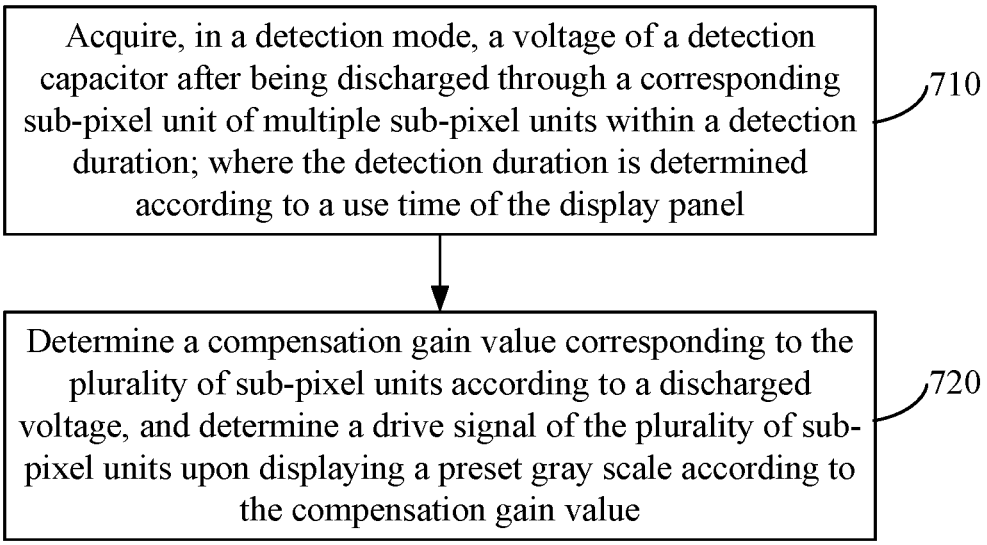
FIG. 8 is a schematic diagram of a driving method of a display panel provided in an embodiment of the present application.

This embodiment further provides a driving method of a display panel, FIG. 8 is a schematic diagram of a driving method of a display panel provided in an embodiment of the present application, and referring to FIG. 8, the method includes steps 710-720.

In step 710, a voltage of each of the plurality of detection capacitors after being discharged through a sub-pixel unit corresponding to each of the plurality of detection capacitors within a detection time duration is acquired in a detection mode, where the detection time duration is determined according to a service time duration of the display panel.

In step 720, a compensation gain value corresponding to the sub-pixel unit is determined according to a discharged voltage, and a drive signal of the sub-pixel unit upon displaying a preset gray scale is determined according to the compensation gain value.

According to the present application, the voltage of each of the plurality of detection capacitors after being discharged through the sub-pixel unit corresponding to each of the plurality of detection capacitors within the detection time duration is acquired, the compensation gain value corresponding to the sub-pixel unit is determined according to the discharged voltage, and the drive signal of the sub-pixel unit upon displaying the preset gray scale is determined according to the compensation gain value, so that the aging of an OLED device may be compensated, and thus the uneven display of the display panel is improved. Moreover, along with the increase of the service time duration of the display panel, an aging degree of the OLED device in the sub-pixel unit is gradually increased, a discharge capacity of the OLED device is changed, and after each of the plurality of detection capacitors is discharged through the sub-pixel unit for a same time, a voltage value of each of the plurality of detection capacitors after being discharged is changed, so that the voltage value of each of the plurality of detection capacitors after being discharged gradually deviates from an optimal detection range of the drive module, a detection precision of the voltage value after being discharged is reduced, and thus a compensation precision is affected. According to this embodiment, the detection time duration is set to be determined according to the service time duration of the display panel, so that the voltage value of each of the plurality of detection capacitors after being discharged is always in the optimal detection range of the drive module within the detection time duration, the detection precision of the voltage value is improved, a determination precision of a compensation gain is improved, and thus an aging compensation precision of the display panel is improved.

In an embodiment, the compensation gain value corresponding to the sub-pixel unit is determined by adopting a following formula:

$$\text{Gain} = \frac{T23}{t23} \cdot \frac{V_{REF} - V_{SEN0}}{V_{REF} - V_{SEN}}$$

In a case of t>tp, then T23=K*t; in a case of t $\leqslant$ tp, then T23=t23; K is an aging coefficient, t is the service time duration of the display panel, and tp is a time constant;

$V_{SEN}$ is a voltage of each of the plurality of detection capacitors after being discharged within the detection time duration T23 at a current moment; $V_{SEN0}$ is a voltage of each of the plurality of detection capacitors after being discharged within an initial detection time duration t23 in factory shipment; $V_{REF}$ is a reference voltage of each of the plurality of detection capacitors before being discharged; and Gain is the compensation gain value corresponding to the sub-pixel unit.

The driving method of the display panel provided in this embodiment belongs to a same inventive concept as the driver circuit of the display panel provided in any embodiment of the present application. For technical details not detailed in this embodiment, reference is made to the description of the driver circuit of the display panel provided in any embodiment of this application.

What is claimed is:

1. A driver circuit of a display panel, wherein the display panel comprises a plurality of sub-pixel units, and the driver circuit comprises:

a plurality of detection capacitors, first ends of the plurality of detection capacitors electrically connected to the plurality of the sub-pixel units of the display panel and second ends of the plurality of detection capacitors being grounded;

a drive module, a first end of the drive module electrically connected to the first end of each of the plurality of detection capacitors, and the drive module is configured to acquire a voltage of each of the plurality of detection capacitors after being discharged through a corresponding sub-pixel unit of the plurality of sub-pixel units within a detection time duration in a detection mode; and a compensation module, electrically connected to a second end of the drive module and configured to determine a compensation gain value corresponding to the each sub-pixel unit according to the voltage after being discharged and determine a drive signal of the each sub-pixel unit upon displaying a preset gray scale according to the compensation gain value;

wherein the detection time duration is determined according to a service time duration of the display panel, wherein the compensation module determines the compensation gain value corresponding to the each sub-pixel unit by adopting a formula as follows $$\text{Gain} = \frac{T23}{t23} \cdot \frac{V_{REF} - V_{SEN0}}{V_{REF} - V_{SEN}},$$

wherein in response to t>tp, T23=K*t, and in response to t≤tp, T23=t23, K is an aging coefficient of the display panel, t is the service time duration of the display panel, and tp is a time constant wherein $V_{SEN}$ is a voltage of each of the plurality of detection capacitors after being discharged within the detection time duration T23 at a current moment, $VS_{SEN0}$ is a voltage of each of the plurality of detection capacitors after being discharged within an initial detection time duration t23 in a factory shipment, $V_{REF}$ is a reference voltage of each of the plurality of detection capacitors before being discharged, and Gain is the compensation gain value corresponding to the each sub-pixel unit.

2. The driver circuit of claim 1, wherein, the drive module comprises a drive unit configured to collect the voltage of each of the plurality of detection capacitors after being discharged within the detection time duration;

the drive unit comprises an analog-to-digital converter; and a detection voltage range of the analog-to-digital converter is determined according to the service time duration of the display panel.

3. The driver circuit of claim 2, wherein, the drive module further comprises a switching unit, and the drive unit is electrically connected to the each sub-pixel unit through the switching unit; and the switching unit is configured to switch to a corresponding conduction channel based on a working state of the drive unit.

4. The driver circuit of claim 3, wherein, the switching unit comprises:

a second switch, a control end of the second switch configured to receive a second control signal, a first end of the second switch electrically connected to the first end of each of the plurality of detection capacitors, and a second end of the second switch configured to receive a reference voltage; and a third switch, a control end of the third switch configured to receive a third control signal, a first end of the third switch electrically connected to the drive unit, and a second end of the third switch connected to the first end of the second switch.

5. The driver circuit of claim 4, further comprising: a first capacitor and a fourth switch;

wherein the each sub-pixel unit comprises a pixel driver circuit for driving the each sub-pixel unit to emit light, a first end of the fourth switch is electrically connected to the first end of the third switch and a first end of the first capacitor, a second end of the fourth switch is electrically connected to the pixel driver circuit through a data bus, a control end of the fourth switch is configured to receive a fourth control signal, and a second end of the first capacitor is grounded.

6. A display panel, comprising the driver circuit of the display panel of claim 1.

7. The display panel of claim 6, wherein, the drive module comprises a drive unit configured to collect the voltage of each of the plurality of detection capacitors after being discharged within the detection time duration;

the drive unit comprises an analog-to-digital converter; and a detection voltage range of the analog-to-digital converter is determined according to the service time duration of the display panel.

8. The display panel of claim 7, wherein, the drive module further comprises a switching unit, and the drive unit is electrically connected to the each sub-pixel unit through the switching unit; and the switching unit is configured to switch to a corresponding conduction channel based on a working state of the drive unit.

9. The display panel of claim 6, wherein the each sub-pixel unit comprises a first switch and an organic light emitting diode;

wherein a first end of the first switch is electrically connected to the organic light-emitting diode, a second end of the first switch is electrically connected to the first end of each of the plurality of detection capacitors, and a control end of the first switch is configured to receive a first control signal.

10. The driver circuit of claim 9, wherein the each sub-pixel unit further comprises a pixel driver circuit configured to drive the plurality of sub-pixel units to emit light, and the first switch is a thin film transistor in the pixel driver circuit.

11. The display panel of claim 6, wherein each of the plurality of sub-pixel unit comprises a pixel driver circuit configured to drive the each sub-pixel unit to emit light, the drive signal comprises a driving current and a driving voltage, and the compensation module determines the drive signal of the each sub-pixel unit upon the each sub-pixel unit displaying the preset gray scale by adopting a formula as follows:

$$I'=Gain\cdot I_0,$$

wherein $I_0$ is a driving current without compensation, I' is a driving current with compensation, and Gain is the compensation gain value corresponding to the each sub-pixel unit;

$V_{DATA}=ELVDD-\sqrt{Gain}\cdot(ELVDD-V_{DATA})$, wherein ELVDD is a first reference voltage of the pixel driver circuit, Gain is the compensation gain value corresponding to the each sub-pixel unit, $V_{DATA}$ is a driving voltage without compensation, and $V_{DATA}'$ is a driving voltage with compensation.

12. The driver circuit of claim 1, wherein, the each sub-pixel unit comprises a first switch and an organic light emitting diode;

wherein a first end of the first switch is electrically connected to the organic light-emitting diode, a second end of the first switch is electrically connected to the first end of each of the plurality of detection capacitors, and a control end of the first switch is configured to receive a first control signal.

13. The driver circuit of claim 12, wherein the first control signal is provided by the drive module or the compensation module.

14. The driver circuit of claim 1, wherein the plurality of sub-pixel units of the display panel are configured in a plurality of columns and each of the plurality of detection capacitors is electrically connected to a corresponding one of the plurality of columns of the sub-pixel units.

15. The driver circuit of claim 1, further comprising a timer electrically connected to a third end of the drive module and configured to measure the service time duration of the display panel;

wherein the drive module is configured to determine the detection time duration according to the service time duration measured by the timer.

16. The driver circuit of claim 1, wherein each of the plurality of sub-pixel unit comprises a pixel driver circuit configured to drive the each sub-pixel unit to emit light, the drive signal comprises a driving current and a driving voltage, and the compensation module determines the drive signal of the each sub-pixel unit upon the each sub-pixel unit displaying the preset gray scale by adopting a formula as follows:

$$I'=Gain\cdot I_0,$$

wherein $I_0$ is a driving current without compensation, I' is a driving current with compensation, and Gain is the compensation gain value corresponding to the each sub-pixel unit;

$V_{DATA}'=ELVDD-\sqrt{Gain}\cdot(ELVDD-V_{DATA})$, wherein ELVDD is a first reference voltage of the pixel driver circuit, Gain is the compensation gain value corresponding to the each sub-pixel unit, $V_{DATA}$ is a driving voltage without compensation, and $V_{DATA}'$ is a driving voltage with compensation.

17. The driver circuit of claim 1, wherein the drive unit is further configured to provide a reference voltage to each of the plurality of detection capacitors.

18. The driver circuit of claim 1, wherein the detection mode comprises a pre-charging stage, a discharging stage, and a voltage sampling stage;

in the pre-charging stage, the drive module provides a reference voltage to each of the plurality of detection capacitors; in the discharging stage, a reference voltage written in each of the plurality of detection capacitors is discharged through the plurality of sub-pixel units; and in the voltage sampling stage, the drive module collects a voltage of each of the plurality of detection capacitors, so that the voltage of each of the plurality of detection capacitors after being discharged through the corresponding sub-pixel unit is determined, wherein the discharging stage and the voltage sampling stage constitute the detection time duration.

* * * * *